United States Patent [19]

Borelli

[11] 3,983,815

[45] Oct. 5, 1976

[54] APPARATUS AND METHOD FOR PRINTING ON PLAIN PAPER

[75] Inventor: Ronald F. Borelli, Edmond, Okla.

[73] Assignee: Honeywell Information Systems, Inc., Waltham, Mass.

[22] Filed: Jan. 29, 1975

[21] Appl. No.: 545,058

[52] U.S. Cl. ..... 101/426; 101/DIG. 13

[51] Int. Cl.[2] ..... B41F 35/00

[58] Field of Search ..... 101/DIG. 13, 426, 465, 101/466, 467, 469; 427/15, 16, 18, 24; 96/1 R, 1 M, 1 A, 1 LY, 1.3, 1.4; 346/74 R, 74 ES, 74 MP; 355/3 R, 17

[56] References Cited

UNITED STATES PATENTS

| | | | |
|---|---|---|---|
| 3,245,341 | 4/1966 | Childress et al. | 101/DIG. 13 |
| 3,332,347 | 7/1967 | Gundlach et al. | 101/469 |
| 3,345,944 | 10/1967 | Simmons | 101/426 |
| 3,363,556 | 1/1968 | Shely et al. | 101/469 |
| 3,443,517 | 5/1969 | Gundlach | 101/DIG. 13 |
| 3,687,541 | 8/1972 | Aser et al. | 355/3 R |
| 3,697,160 | 10/1972 | Clark | 101/DIG. 13 |
| 3,804,511 | 4/1974 | Rait et al. | 355/17 |

OTHER PUBLICATIONS

McCurry, "Contact Electrostatic Printing," IBM Tech. Discl. Bull., vol. 13, No. 10, Mar. 1971.

Hider, "Photoconductor Cleaning System," IBM Tech. Discl. Bull., vol. 9, No. 11, Apr. 1967.

*Primary Examiner*—Ralph T. Rader

*Attorney, Agent, or Firm*—Ronald T. Reiling; Nicholas Prasinos; William F. White

[57] ABSTRACT

An apparatus and method for electrographically printing on a dielectric paper and transferring a toned image from the dielectric paper to plain paper. The dielectric paper receives an electrically charged latent image from an electrode device. The latent image is developed by applying a liquid or dry toner. The toned image on the dielectric paper is transferred onto the plain paper by conveying the dielectric paper and the plain paper together through a pair of conductive rollers. The dielectric paper is dried, fusing the residual image on its surface. The dielectric paper is then reused. The plain paper with the transfer image is dried, cut, and stacked.

13 Claims, 7 Drawing Figures

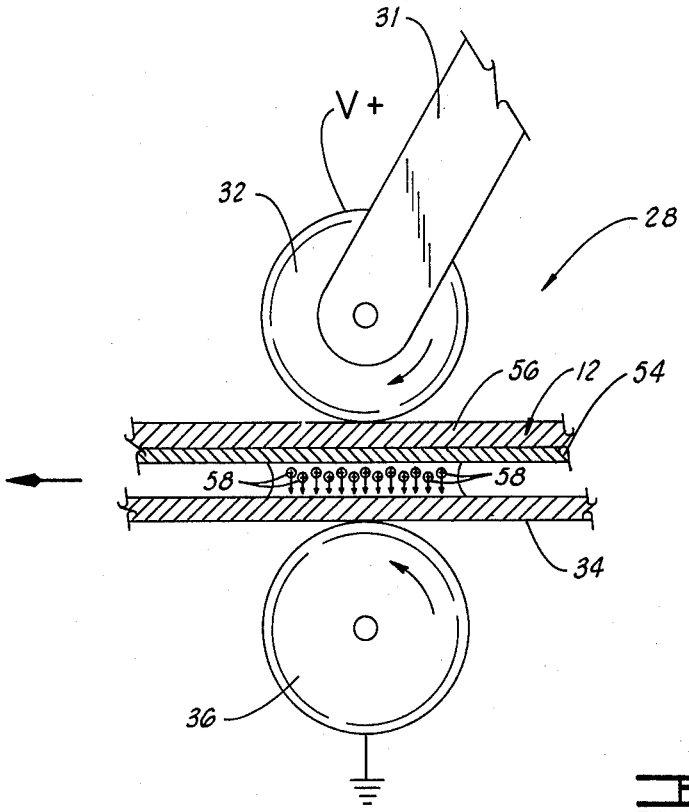
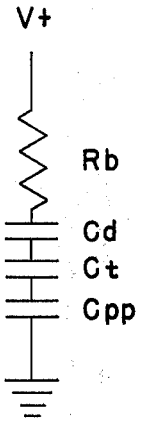
FIG-2A
FIG-2
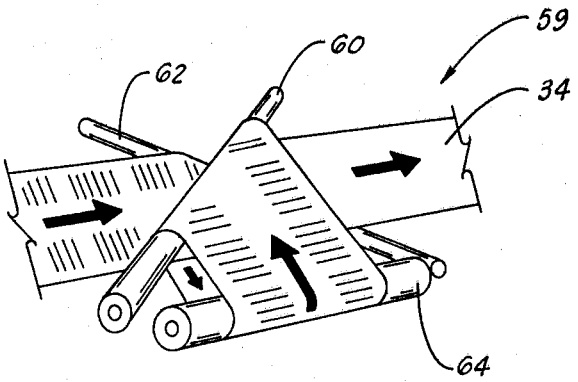
FIG-3

APPARATUS AND METHOD FOR PRINTING ON PLAIN PAPER

BACKGROUND OF THE INVENTION

This invention relates generally to printing on plain paper and more particularly, but not by way of limitation, to an apparatus and method for transferring an image on dielectric paper to plain paper.

In xerography and related processes, an image is electrically charged on a photoreceptor. The image is developed by a toner. The toned image is transferred from the photo-receptor onto conventional plain paper. The toned image on the plain paper is then dried. The residual toner on the photoreceptor is cleaned, and the image discharged before the cycle is repeated.

In one type of electrostatic printing, a series of electrodes are electrically pulsed. The electrodes discharge ions which form an electrically charged latent image on a dielectric paper. The image on the medium is a mirror image of the surface of the electrode. The image may be in the form of a print character or a series of images may be combined to form a print character. The charged latent images on the dielectric paper are toned in a conventional manner and then dried. In this type of printing, dielectric paper is used rather than plain paper because plain paper does not retain the charged latent image well enough to permit adequate developing by the toner. Because a special paper is required, the costs of the paper may be higher than the costs of plain paper.

Another method of electrostatic printing does use plain paper. A toner mist is introduced between electrodes discharging an ion flow and a plain paper medium. The ion flow, which is controlled by a selectively-energized aperture board, impinge on the toner mist particles. A toned image is formed on the plain paper and then dried. This system has the problem of properly controlling the ion flow through the aperture board. Also, there is a problem of controlling the particle size of the toner mist and cleaning the excess toner which may clog the apertures.

SUMMARY OF THE INVENTION

The present invention is an apparatus using a dielectric paper which transfers a toned image to plain paper. After the transfer, the dielectric paper is dried, thereby fusing the residual image to the dielectric surface. The dielectric paper is then reused. By using a dielectric paper, the problems of cleaning and discharging the image on a photoreceptor are avoided.

The transfer process from the dielectric paper to the plain paper results in a low cost transfer process since the dielectric paper is reusable. Also, by using a dielectric paper, a multiple color image may be produced and transferred to plain paper.

The apparatus includes a dielectric paper for receiving an electrostatic charge forming a charged latent image. The dielectric paper is toned to develop the latent image. The toned image on the dielectric paper is placed in contact with the surface of the plain paper. By placing a high voltage potential across the paper master and the plain paper while they are in contact, the toned image is transferred to the plain paper.

The advantages and objects of the invention will become evident from the following detailed description when read in conjunction with the accompanying drawings which illustrate a preferred embodiment of the invention.

BRIEF DESCRIPTION OF THE DRAWINGS

FIG. 2 is a side view of a transfer station.

FIG. 2(A) is an electrical representation of the transfer station.

FIG. 3 is an illustration of a paper turning apparatus.

DETAILED DESCRIPTION

Figure 1:
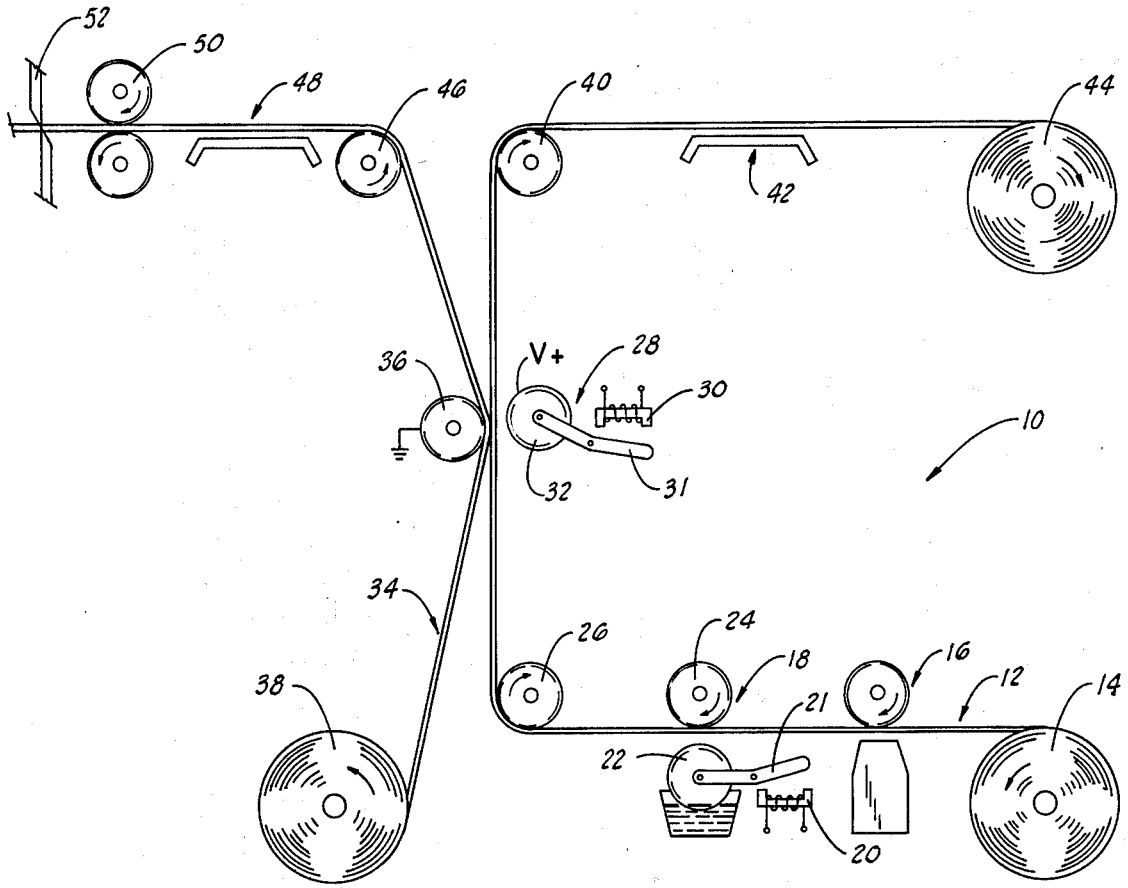
FIG. 1 is a plan view of the apparatus for printing on plain paper.

In FIG. 1 the apparatus for electrographically printing on plain paper is designated by the general reference character 10. A dielectric paper 12 is fed from a supply roll 14 through the apparatus 10. The paper 12 receives an electrically charged latent image at image station 16. The image may be placed on the paper 12 by pulse electrodes, photo-optical means, or any other means known in the art for producing a latent charged image.

The latent charged image on the paper 12 is developed at toning station 18. The toning station is selectively actuated by an electromagnetic actuator 20, which engages an arm 21 of an unpowered toner applicator 22. The applicator 22, rotated by the paper 12, picks up toner and applies it to the latent image. A backup roller 24 is used to bias the paper 12 against the surface of the applicator 22. While the above described toning station is one method of applying toner, there are a number of different but suitable ways of applying both liquid and dry toners known to those skilled in the art.

The developed image on the paper 12 is guided by guide roller 26 to a transfer station 28. The transfer station 28 includes an electromagnetic actuator 30 which engages an arm 31 of a conductor roller 32 and selectively rotates the conductive roller 32 against the untoned side of paper 12. The paper 12 is pressed against a plain paper 34, backed by a backup conductive roller 36. The plain paper 34 is fed from a supply roller 38. As the paper 12 and plain paper 34 are pressed together by roller 32 and roller 36, the toner is transferred to the plain paper by electrical means discussed in FIG. 2.

From the transfer station 28, the paper 12 is guided by a guide roller 40 to a drying station 42. The drying station fuses the residual toner to paper 12. The residual toner is normally ten percent or less of the original toner. Also, at this time any remaining electrical charge at the image is dispersed. It has been found that the dielectric paper can be reimaged over the fused residual toner with negligible loss of the print quality.

The paper 12 leaves the drying station 42 and is wound on a takeup roller 44. When the paper 12 has been unwound from the supply roll 14, the direction of the feed of the paper 12 on the takeup roller and the supply roller is reversed and the supply roller is rewound. When the supply roller is rewound, the paper 12 is ready to be reused.

Referring back to the transfer station 28, the plain paper 34 with the transferred image thereon is guided by guide roller 46 to a drying station 48 where the transferred image is fused to the plain paper. From the drying station 48, the plain paper 34 is conveyed through drive rollers 50 and then to cutters 52 which cut the plain paper 34 to the required length.

Figure 1A:
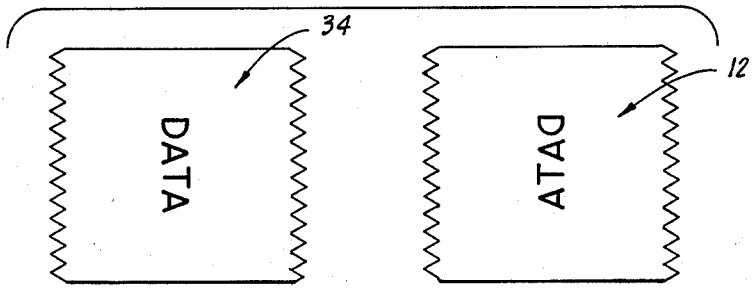
FIG. 1(A) is an illustration of an image produced on a dielectric paper and the image transferred onto plain paper.

FIG. 1(A) illustrates an image received and toned on the dielectric paper 12. The image is shown depicting the word "DATA" produced in an inverted form on the paper 12. When the toned image is transferred from the paper 12 to the plain paper 34, the word DATA is reproduced in its proper form.

In FIG. 2 an enlarged side view of the transfer station 28 is illustrated. Conductive roller 32 connected to arm 31 presses the dielectric paper 12 against plain paper 34 which is supported by the backup conductor roller 36. Conductive roller 32 has a positive electrical potential. The backup conductor roller 36 is shown grounded.

The paper 12 has a dielectric coating 54 and a conductive base 56. The initial latent image is formed on the coating 54 using negative ions. This latent image is toned in the toning station 18 with positively charged toner particles which are attracted to the negative ions.

The positively charged toner particles 58 are shown in FIG. 2 adhering to the dielectric coating 54. By applying a positive voltage of from 700 to 1200 volts to the conductive roller 32, the toner particles 58 are repelled from the dielectric coating 54 and are transferred to the surface of the plain paper 34.

FIG. 2(A) represents a simplified electrical representation of the transfer process. The conductivity of the circuit is directly related to the voltage level required to be applied to the conductive roller 32. The voltage (V+) required to transfer the toned image effectively depends on the resistence (Rb) of the conductive base 56, the capacitance (Cd) of the dielectric coating 54, the capacitance (Ct) of the toner particles 58 and the capacitance (Cpp) of the plain paper 34.

Experimentation has shown that approximately ninety percent of the toner on the dielectric paper can be transferred to the plain paper using this process. The toner remaining on the paper master is fused permanently by heat to the surface of paper 12. The heat also disperses any remaining electrical charge. The dielectric paper can be reused ten or more times before serious degradation of print quality occurs.

FIG. 3 illustrates a paper turning apparatus 59. The apparatus is well-known in the art and is used for printing and copying on both sides of a paper. The apparatus 59 includes turning bar 60 and 62 at approximately 45° to the path of the plain paper 34 and a guide roller 64 parallel to the path of the paper. Referring to FIG. 1, by adding an additional transfer station similar to transfer station 28, the apparatus 59 can be used to reverse the plain paper 34 between the first transfer station and the additional transfer station, thereby allowing a toned image to be transferred to both sides of the plain paper 34.

Figure 4:
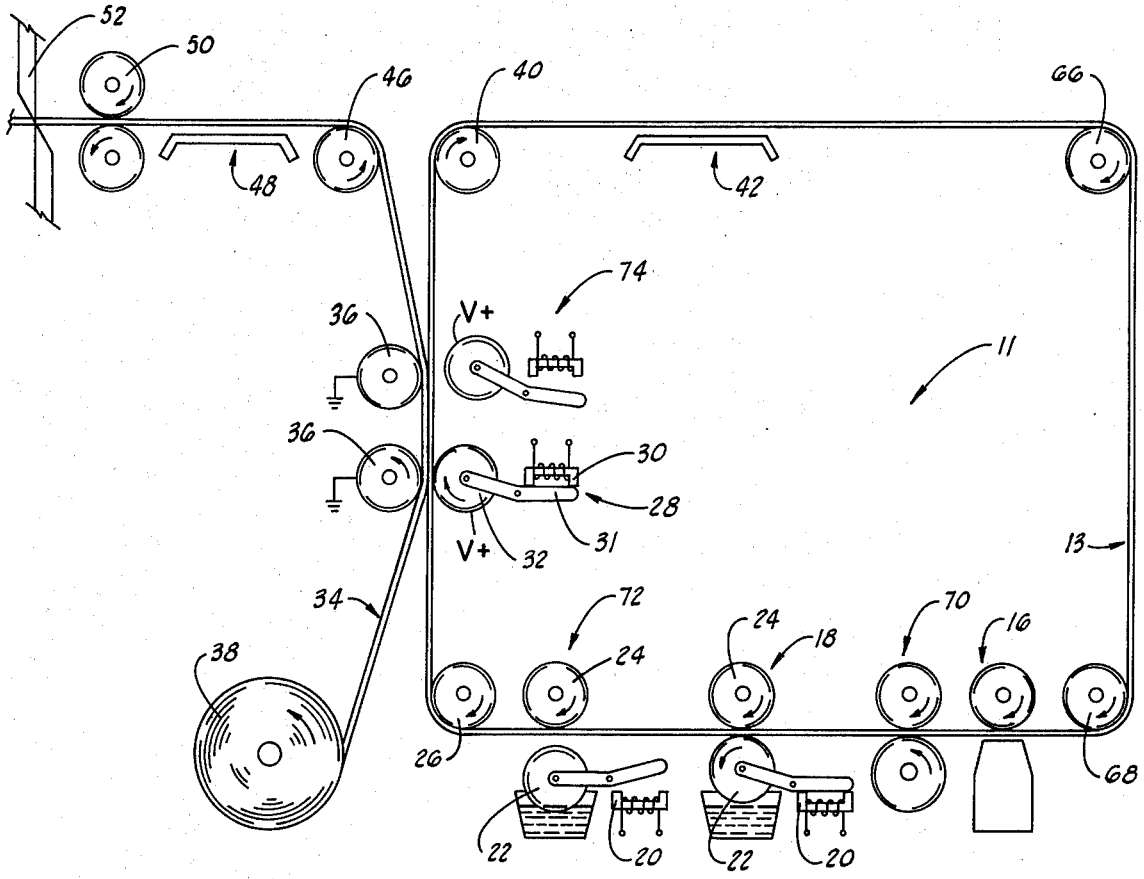
FIG. 4 is an alternate embodiment of the apparatus shown in FIG. 1.

In FIG. 4, an apparatus 11 is shown with dielectric paper 13 as a continuous belt. The continuous belt of the paper 13 passes over additional guide rollers 66 and 68. Apparatus 11 further includes a form imaging station 70, a second toning station 72, and a second transfer station 74.

In this illustration, image station 16 is used to print variable data on the dielectric paper 13. The form imaging station 70 can be used for printing forms on the dielectric paper 13.

The toning stations 18 and 72 are used to tone the variable data and form using different colors. This is done by actuating the station 18 so that it tones the variable data as it passes through the station 18. The station 18 is then de-actuated as the form image passes through the station. While the toned variable data passes through the second toning station 72, this station is de-actuated. However, while the form image passes through the station 72, the station is actuated and the form image is developed with a different color.

As can be seen in FIG. 4, the dielectric paper 13 and plain paper 34 are independently driven. This allows the speed of the paper 13 and the plain paper 34 to be controlled separately as they pass the transfer stations 28 and 74. This is of importance since the speed of the plain paper must be controlled so that it receives the variable data as it passes station 28, and the form information as it later passes station 74. The form and variable information are superimposed at the same place on plain paper 34, thereby producing a multiple colored toned image on the plain paper.

Figure 4A:
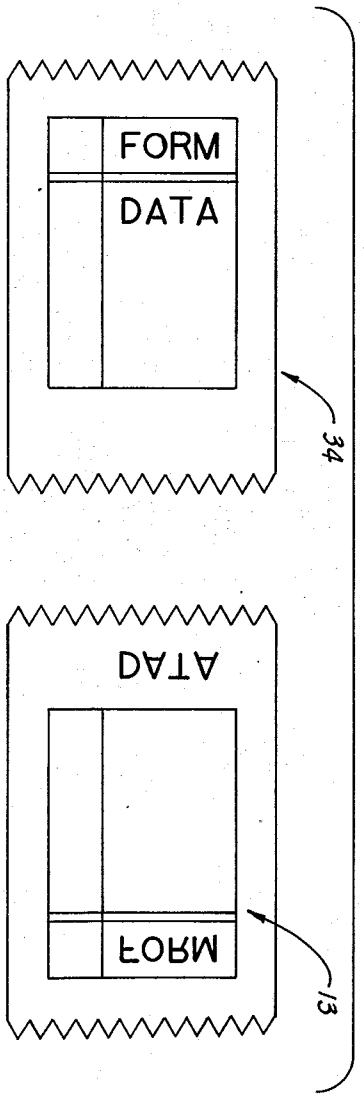
FIG. 4(A) is an illustration of a transfer of multiple images from the dielectric paper and the images transferred onto the plain paper.

FIG. 4(A) illustrates multiple color information on the dielectric paper 13 and the plain paper 34. On the paper 13, the variable information is represented by the word DATA. The DATA can be of one color. The form information is represented as a lined form and the word "FORM". This form information can be of another color.

On the plain paper 34, the variable information DATA and the form information FORM are superimposed producing a multiple color image. By adding additional toner stations and transfer stations, a greater number of colors can be superimposed on the plain paper if it is so desired.

In operation, the variable data information represented by the word DATA on the paper 13 is received first at the variable image station 16. The paper 13 then passes through the forms imaging station 70 and receives the form image shown as a lined form and including the word FORM. As the paper 13 passes through the first toning station 18, the variable information represented by the latent image DATA is toned with one color. The toning station 18 is then de-actuated and the latent form image passes through without being toned. The variable toned data information now passes through the second toning station 72 which is de-actuated to allow the already toned variable data information to pass through. The station 74 is actuated when the latent form image passes through and this information is toned with a different color. The toned images are conveyed to the transfer station 28 where the variable data represented by the word DATA is first transferred to the plain paper 34. After the plain paper 34 receives the variable data information, the speed of the plain paper 34 and paper 13 are coordinated so that the toned form image can be transposed at station 74 on top of the toned variable data information thereby completing the transfer of the multiple color image on the plain paper.

The paper turning apparatus 59 can also be used in the transfer of multiple color images on both sides of the plain paper. This can be done by adding two additional transfer stations similar to stations 28 and 72 and reversing the plain paper with the apparatus 59 before it passes through the additional stations.

Changes may be made in the construction and arrangement of the parts or elements of the embodiment disclosed herein without departing from the spirit or scope of the invention as defined in the following claims.

What is claimed is:

1. An apparatus for electrographically printing on plain paper, the apparatus comprising:
   a dielectric-coated paper;
   first imaging means for applying an electrically charged latent image to the surface of said dielectric-coated paper;
   first toning means for developing the electrically charged latent image on said dielectric-coated paper;
   first transfer means for electrically transferring the image from said dielectric-coated paper onto the plain paper by pressing said dielectric-coated paper against said plain paper, whereby a residual toned image remains on said dielectric-coated paper; and
   drying means for fusing the residual toned image to said dielectric-coated paper while dispersing the remaining electrical charge thereon so that said dielectric-coated paper may be re-imaged over said fused residual toned image.

2. The apparatus as defined in claim 1 wherein said dielectric-coated paper is reusable.

3. The apparatus as defined in claim 2 wherein said dielectric-coated paper is mounted on a supply roll and fed onto a takeup roll, the dielectric-coated paper being reusable by rewinding the dielectric-coated paper from the takeup roll onto the supply roll.

4. The apparatus as defined in claim 2 wherein said reusable dielectric paper is an endless belt.

5. An apparatus for electrograhically printing with multiple colors on plain paper, the apparatus comprising:
   a dielectric paper;
   first imaging means for applying an electrically charged first latent image on the dielectric surface of said dielectric paper;
   second imaging means for applying electrically charged second latent image on the dielectric surface of said dielectric paper;
   first toning means for developing the electrically charged first latent image with one toner color on said dielectric paper;
   second toning means for developing the electrically charged second latent image with another toner color on said dielectric paper;
   first transfer means for electrically transferring the toned first image onto the plain paper by pressing said dielectric paper against said plain paper; and
   second transfer means for electrically transferring the toned second image onto the plain paper by pressing said dielectric paper against said plain paper so as to cause the second image to be in superposition with the transferred first image.

6. The apparatus as defined in claim 5 wherein said first and second transfer means each include conductive rollers disposed adjacent to each other, the dielectric surface of said dielectric paper and the plain paper pressing against another as they pass between said rollers, one of said rollers in contact with said dielectric paper having the same polarity as the toned image on the dielectric surface, the other roller in contact with the plain paper being electrically grounded or having a polarity opposite the polarity of the toned image.

7. A method of electrographically printing on plain paper comprising the steps of:
   forming an electrically charged latent image on the surface of a dielectric paper master;
   developing said latent image on said dielectric paper by applying toner thereto;
   electrically transferring said toned image onto the plain paper by pressing the dielectric paper master against the plain paper whereby a residual toned image remains on said dielectric paper master;
   drying the transposed image on the plain paper to fuse the image thereon; and
   drying said dielectric paper master to fuse the residual toned image and disperse the remaining electrical charge thereon so that the dielectric paper master may be re-imaged over the fuse residual toned image.

8. The method as defined in claim 7 further including the step of reusing said dielectric paper after said dielectric paper has been dried.

9. A method of electrographically printing multiple colors on plain paper comprising the steps of:
   forming an electrically charged first latent image on the surface of a dielectric paper master;
   forming an electrically charged second latent image on the surface of said paper master;
   developing said first electrically charged latent image by applying toner of one color;
   developing said second electrically charged latent image by applying toner of another color;
   electrically transferring said developed first image onto the plain paper by pressing the dielectric paper master against the plain paper; and
   electrically transferring said developed second image onto the plain paper by pressing the dielectric paper master against the plain paper so as to cause the second image to be in superposition with said transferred first image.

10. The method of claim 9 wherein said steps of transferring the first and second images onto the plain paper comprise:
   pressing the dielectric-coated paper against the plain paper as they pass between conductive rollers; and
   maintaining the polarity on said rollers in contact with said dielectric paper the same as the polarity of the toned image on the dielectric surface.

11. An apparatus for electrographically printing on plain paper, the apparatus comprising:
   a dielectric-coated paper;
   first imaging means for applying an electrically charged latent image to the surface of said dielectric-coated paper;
   first toning means for developing the electrically charged latent image on said dielectric-coated paper; and
   first transfer means for electrically transferring the image onto the plain paper, said first transfer means including conductive rollers disposed adjacent to each other, the dielectric surface of said dielectric-coated paper and the plain paper contacting one another as they pass between said rollers, one of said rollers in contact with said dielectric-coated paper having the same polarity as the toned image on the dielectric surface, the other roller in contact with the plain paper being electrically grounded or having a polarity opposite the polarity of the toned image.

12. The apparatus as defined in claim 11 further including:

second imaging means for applying an electrically charged second latent image to the surface of said dielectric-coated paper;

second toning means for developing the electrically charged second latent image; and second transfer means for transferring the second latent image onto the plain paper.

13. The apparatus as defined in claim 11 further including an additional transfer means and a paper turning means for turning the plain paper over so that the plain paper can receive a toned image on both sides, said paper turning means being positioned between said first transfer means and said additional transfer means whereby said paper is turned over therebetween.

* * * * *

UNITED STATES PATENT OFFICE

CERTIFICATE OF CORRECTION

PATENT NO. : 3,983,815

DATED : October 5, 1976

INVENTOR(S) : Ronald F. Borelli

It is certified that error appears in the above-identified patent and that said Letters Patent are hereby corrected as shown below:

Column 5, line 63, after "against" insert --one--.

Signed and Sealed this

Twenty-first Day of December 1976

[SEAL]

*Attest:*

RUTH C. MASON
*Attesting Officer*

C. MARSHALL DANN
*Commissioner of Patents and Trademarks*